US011311170B2

(12) United States Patent
Eisenbart et al.

(10) Patent No.: US 11,311,170 B2
(45) Date of Patent: Apr. 26, 2022

(54) DOMESTIC DISHWASHER HAVING A SPRAY DEVICE

(71) Applicant: BSH Hausgeräte GmbH, Munich (DE)

(72) Inventors: Bernd Eisenbart, Holzheim (DE); Michael Lugert, Jettingen-Scheppach (DE); Werner Oblinger, Mödingen (DE)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 17/047,078

(22) PCT Filed: Apr. 23, 2019

(86) PCT No.: PCT/EP2019/060373
§ 371 (c)(1),
(2) Date: Oct. 13, 2020

(87) PCT Pub. No.: WO2019/206913
PCT Pub. Date: Oct. 31, 2019

(65) Prior Publication Data

US 2021/0145243 A1 May 20, 2021

(30) Foreign Application Priority Data

Apr. 26, 2018 (DE) ..... 102018206443.1

(51) Int. Cl.
*A47L 15/16* (2006.01)
*A47L 15/42* (2006.01)

(52) U.S. Cl.
CPC ..... *A47L 15/428* (2013.01); *A47L 15/16* (2013.01)

(58) Field of Classification Search
None
See application file for complete search history.

(56) References Cited

U.S. PATENT DOCUMENTS

| | | | |
|---|---|---|---|
| 2010/0116301 | A1 | 5/2010 | Heisele et al. |
| 2015/0102127 | A1 | 4/2015 | Bentley et al. |

FOREIGN PATENT DOCUMENTS

| | | | |
|---|---|---|---|
| CN | 201505114 | U | 6/2010 |
| EP | 1382287 | A2 | 1/2004 |
| JP | 2003225622 | A | 8/2003 |
| KR | 20070062296 | A | 6/2007 |
| WO | 2018113912 | A1 | 6/2018 |

OTHER PUBLICATIONS

National Search Report DE 102018206443.1 dated Nov. 23, 2018.
International Search Report PCT/EP2019/060373 dated Aug. 6, 2019.

*Primary Examiner* — Levon J Shahinian
(74) *Attorney, Agent, or Firm* — Michael E. Tschupp; Andre Pallapies; Brandon G. Braun

(57) ABSTRACT

A household dishwasher includes a washing compartment and a spray device arranged inside the washing compartment and configured to spray washing liquor and/or clean water within the washing container. The spray device includes a cage and a rotary element which is mounted in the cage for rotation about an axis of rotation. The rotary element includes a bearing surface which is radially distanced from the axis of rotation and extending around the axis of rotation for enabling the rotary element to be mounted rotatably in the cage.

10 Claims, 5 Drawing Sheets

DOMESTIC DISHWASHER HAVING A SPRAY DEVICE

CROSS-REFERENCES TO RELATED APPLICATIONS

This application is the U.S. National Stage of International Application No. PCT/EP2019/060373, filed Apr. 23, 2019, which designated the United States and has been published as International Publication No. WO 2019/206913 A1 and which claims the priority of German Patent Application, Ser. No. 10 2018 206 443.1, filed Apr. 26, 2018, pursuant to 35 U.S.C. 119(a)-(d).

BACKGROUND OF THE INVENTION

The present invention relates to a household dishwasher.

A dishwasher may have a washing container and spray devices arranged in the washing container for spraying items to be washed with washing liquor and/or clean water. For example, such a spray device may be mounted, in particular, as a so-called top spinning unit, on a ceiling of the washing container.

EP 1 382 287 A2 discloses a rotatable spray head for an automatic dishwasher having one or more spray openings. The spray head is rotatably mounted and is secured on the tub side by a hoop-shaped holding arm. With each revolution, the holding arm interrupts one or more times the water jets exiting from the spray openings, which enhances the cleaning action.

EP 2 134 230 B1 discloses a dishwasher having a hydraulic system and at least one top spray device which is arranged above a dish rack, which may be supplied with washing liquor by means of the hydraulic system and which has a rotatable spray head which is fastened by means of a cage to the hydraulic system. In this case, the spray head is rotatably mounted in the cage.

BRIEF SUMMARY OF THE INVENTION

Against this background, an object of the invention is to provide an improved household dishwasher.

Accordingly, a household dishwasher is proposed. The household dishwasher comprises a washing compartment and at least one spray device that is arranged inside said washing compartment and is intended to spray washing liquor and/or clean water within the washing container, wherein the spray device comprises a cage and a rotary element that is mounted in said cage so as to rotate about an axis of rotation, wherein said rotary element comprises a bearing surface which is radially distanced from the axis of rotation and extends around same, and with the aid of which said rotary element is mounted rotatably in the cage.

As the rotary element is not centrally mounted on the axis of rotation but on the bearing surface which is arranged radially distanced from the axis of rotation, a large bearing clearance may be provided both in an axial direction and in a radial direction. As a result, blocking or jamming of the rotary element in the cage due to dirt particles is reliably prevented.

In particular, the rotary element is arranged inside the cage and mounted thereon. "Radially distanced" in the present case may be understood as the bearing surface being arranged at a distance from the axis of rotation, viewed in a radial direction of the spray device and/or the rotary element. The radial direction is oriented, in particular, perpendicular to the axis of rotation and away therefrom. By means of the bearing surface, the rotary element is preferably mounted in an axial direction on the cage. The axial direction in this case is oriented parallel to the axis of rotation or coincides therewith. The bearing surface in this case circulates around the axis of rotation, in particular in an annular manner, and preferably entirely. The spray device may be fastened, for example, fixedly to the washing container or to a receptacle for items to be washed received in the washing container. Moreover, the spray device may be arranged on a bottom or on a ceiling of the washing container. The spray device may also be arranged on a spray arm rotatably mounted on or in the washing container. Preferably, a plurality of spray devices is provided. By means of the spray device in the washing container a so-called intensive washing zone may be implemented. By means of such an intensive washing zone, items to be washed which are difficult to clean and/or heavily soiled, such as for example bottles, dishes, bowls, pots or the like, may be cleaned in a simple manner. The cage is preferably fastened to a housing of the spray device. For example, the cage may be snapped or latched to the housing. Alternatively, the cage may also be configured integrally, in particular made of a single material, with the housing. Preferably, the cage, the rotary element and the housing are plastic components, in particular plastic injection-molded components.

According to an embodiment, the cage has a plurality of bearing portions, the bearing surface bearing thereagainst during the operation of the spray device.

Preferably, the rotary element is arranged between the cage and the housing. For example, when the spray device is out of operation, the rotary element may be positioned on the housing. As soon as the rotary element is supplied with washing liquor and/or clean water, the rotary element is raised from the housing and the bearing surface of the rotary element is placed against the bearing portions of the cage. Preferably, at least three bearing portions are provided. However, more than three bearing portions, for example eight bearing portions, may also be provided. The bearing portions are provided on a bearing surface of the cage and extend out of said cage. The bearing surface of the cage faces the bearing surface of the rotary element.

According to a further embodiment, the bearing portions are arranged equally distanced from one another, wherein in each case an intermediate space is provided between two adjacent bearing portions.

Preferably, the bearing portions are arranged equally distributed around a circumference of the cage. In each case an intermediate space is arranged between two bearing portions and in each case a bearing portion is arranged between two intermediate spaces. Since the intermediate spaces are provided, a jamming of the rotary element in the cage due to dirt particles is reliably prevented, as the dirt particles are flushed through the intermediate spaces.

According to a further embodiment, the cage comprises a bearing ring circulating around the axis of rotation, the bearing portions being provided thereon.

Preferably a plurality of struts, for example three thereof, are provided on the bearing ring, the cage being connected thereby to the housing. In this case, each strut may be assigned two snap hooks which are designed to engage in one respective corresponding recess of the housing. As a result, the cage may be snapped or latched to the housing. As a result, it is possible to dismantle the cage in a simple manner. Preferably, the struts are equally distributed over a circumference of the bearing ring. For example, three struts are provided. The bearing ring and the struts are an integral component, in particular made of a single material. In this case the bearing portions extend in the direction of the struts.

According to a further embodiment, the household dishwasher further comprises a nozzle for supplying the washing liquor and/or the clean water to the rotary element, wherein the nozzle is designed to inject the washing liquor and/or the clean water centrally onto the rotary element.

To this end, the nozzle may be provided centrally below or above the rotary element. In particular, the nozzle may be positioned centrally relative to the axis of rotation. The nozzle, however, may also be positioned offset to the rotary element and/or to the axis of rotation.

According to a further embodiment, the rotary element comprises rotor blades and a connecting ring which circulates around the axis of rotation and which connects the rotor blades together, wherein the bearing surface is provided on the connecting ring.

Preferably, a plurality of rotor blades is provided. For example, three or four rotor blades may be provided. As soon as the rotor blades are supplied with the washing liquor and/or the clean water, the rotary element is set in rotation. As a result, the washing liquor and/or the clean water is distributed with a hemispherical spray pattern about the spray device. This conical spray pattern improves the cleaning performance.

According to a further embodiment, the rotary element comprises a hub which is connected to the rotor blades, wherein the hub is designed to supply the washing liquor and/or the clean water to the rotor blades during the operation of the spray device.

In particular, the nozzle injects the washing liquor and/or the clean water centrally onto the hub. The hub then distributes the washing liquor and/or the clean water onto the rotor blades.

According to a further embodiment, the hub is constructed rotationally symmetrically to the axis of rotation and has an at least partially conical envelope surface.

The hub preferably has a conical geometry with a cone point or tip. A cone half angle or cone angle of the envelope surface may, for example, be 30° to 60°, further preferably 40° to 50°, further preferably 45°. Along the envelope surface, the washing liquor and/or the clean water is supplied to the rotor blades. By varying the geometry of the envelope surface, in other words by varying the cone angle, the spray pattern of the spray device is freely definable. By means of very different cone angles of the hub and the rotation thereof, an approximately completely filled hemispherical spray pattern may be generated around the spray device.

According to a further embodiment, the rotor blades are inclined at an angle of inclination relative to the axis of rotation.

The angle of inclination may, for example, be 40° to 70°, preferably 45° to 65°, further preferably 50° to 60°, further preferably 55°. The angle of inclination, however, may adopt any other values. The rotor blades, viewed in the radial direction, may additionally have a bent or curved shape.

According to a further embodiment the cage is curved, in particular curved in a spherical cap-shaped manner.

As a result, a particularly compact construction of the spray device is produced. Alternatively, the cage may also have a different geometry.

Further possible implementations of the household dishwasher also comprise not explicitly cited combinations of features or embodiments described above or below relative to the exemplary embodiments. In this case, the person skilled in the art will also add individual features as improvements or additions to the respective basic shape of the household dishwasher.

BRIEF DESCRIPTION OF THE DRAWINGS

Further advantageous embodiments and features of the household dishwasher form the subject matter of the subclaims and the exemplary embodiments of the household dishwasher described below. Moreover, the household dishwasher may be described in more detail by means of preferred embodiments with reference to the accompanying figures.

DETAILED DESCRIPTION OF EXEMPLARY EMBODIMENTS OF THE PRESENT INVENTION

Figure 1:
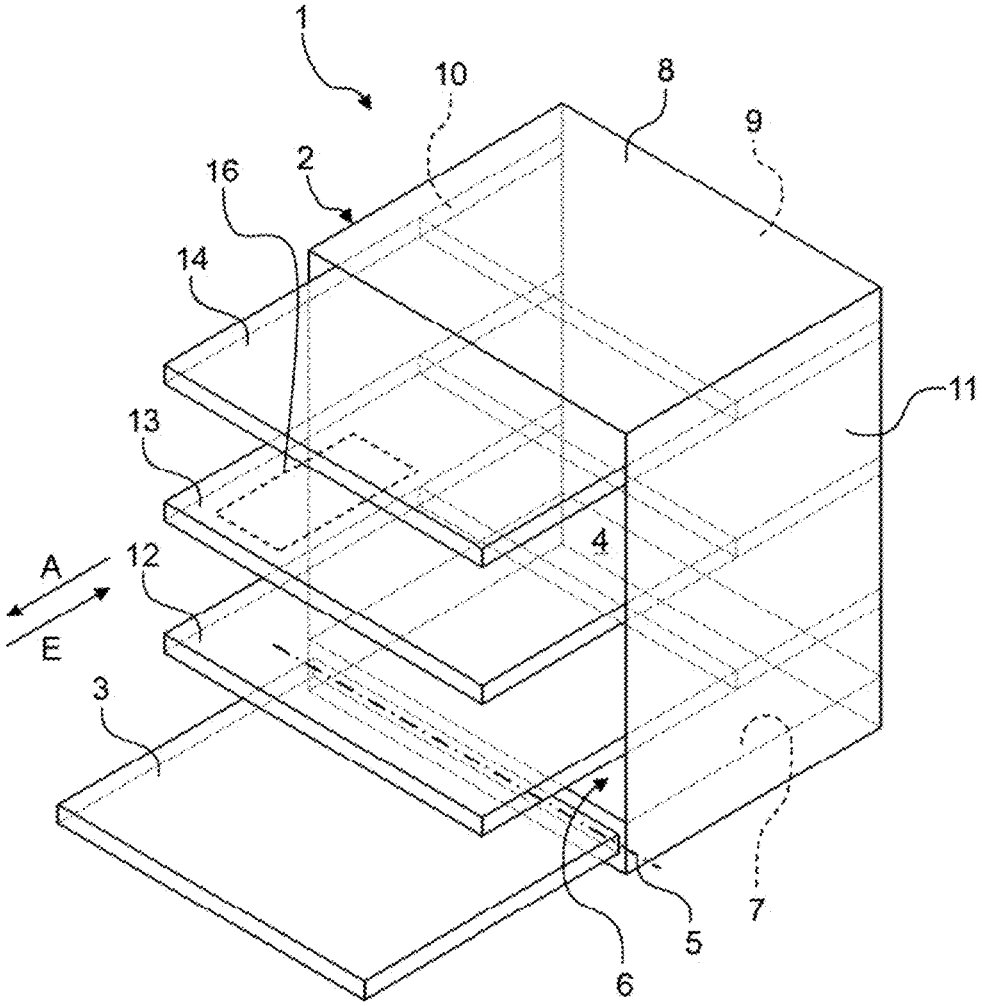
FIG. 1 shows a schematic perspective view of an embodiment of a household dishwasher.

Elements which are identical or functionally identical have been provided in the figures with the same reference numerals, unless indicated otherwise.

FIG. 1 shows a schematic perspective view of an embodiment of a household dishwasher 1. The household dishwasher 1 comprises a washing container 2 which is closable by a door 3, in particular in a watertight manner. To this end, a sealing device may be provided between the door 3 and the washing container 2. The washing container 2 is preferably cuboidal. The washing container 2 may be arranged in a housing of the household dishwasher 1. The washing container 2 and the door 3 may form a dishwasher interior 4 for washing items to be washed.

The door 3 is shown in FIG. 1 in its open position. The door 3 may be closed or opened by pivoting about a pivot axis 5 provided on a lower end of the door 3. A loading opening 6 of the washing container 2 may be closed or opened by means of the door 3. The washing container 2 has a bottom 7, a ceiling 8 arranged opposite the bottom 7, a rear wall 9 arranged opposite the closed door 3, and two opposingly arranged side walls 10, 11. The bottom 7, the ceiling 8, the rear wall 9 and the side walls 10, 11 may be manufactured, for example, from a stainless steel sheet. Alternatively, for example, the bottom 7 may be manufactured from a plastic material.

The household dishwasher 1 also has at least one receptacle for items to be washed 12 to 14. Preferably, a plurality of receptacles for items to be washed 12 to 14, for example three thereof, may be provided, wherein the receptacle for items to be washed 12 may be a lower receptacle for items to be washed or a lower basket, the receptacle for items to be washed 13 may be an upper receptacle for items to be washed or an upper basket and the receptacle for items to be washed 14 may be a cutlery drawer. As FIG. 1 further shows, the receptacles for items to be washed 12 to 14 are arranged one on top of the other in the washing container 2. Each receptacle for items to be washed 12 to 14 is optionally displaceable into or out of the washing container 2. In particular, each receptacle for items to be washed 12 to 14 may be pushed or inserted in an insertion direction E into the washing container 2 and pulled or extended out of the washing container 2 counter to the insertion direction E in a pull-out direction A.

Figure 2:
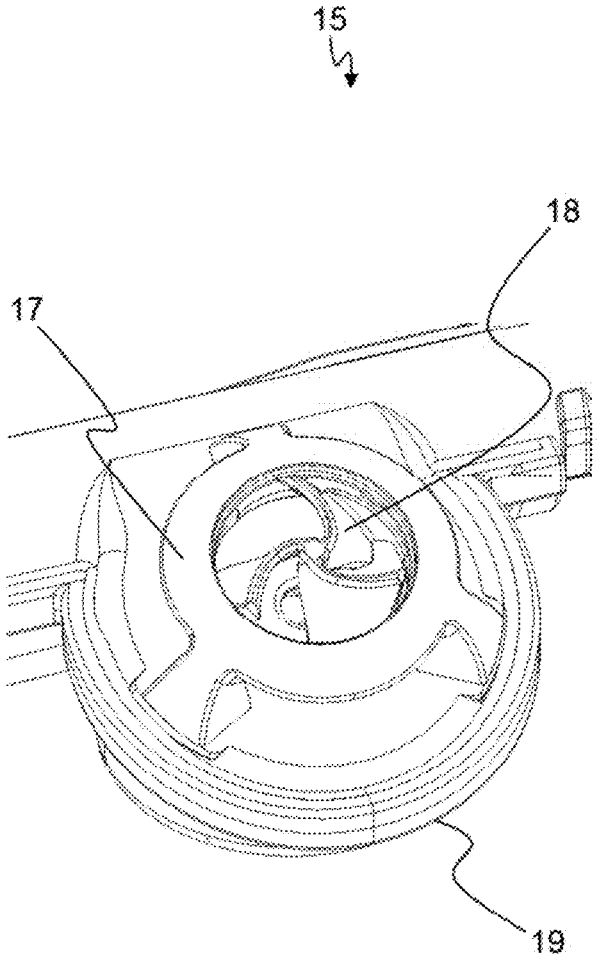
FIG. 2 shows a schematic perspective view of an embodiment of a spray device for the household dishwasher according to FIG. 2.
Figure 3:
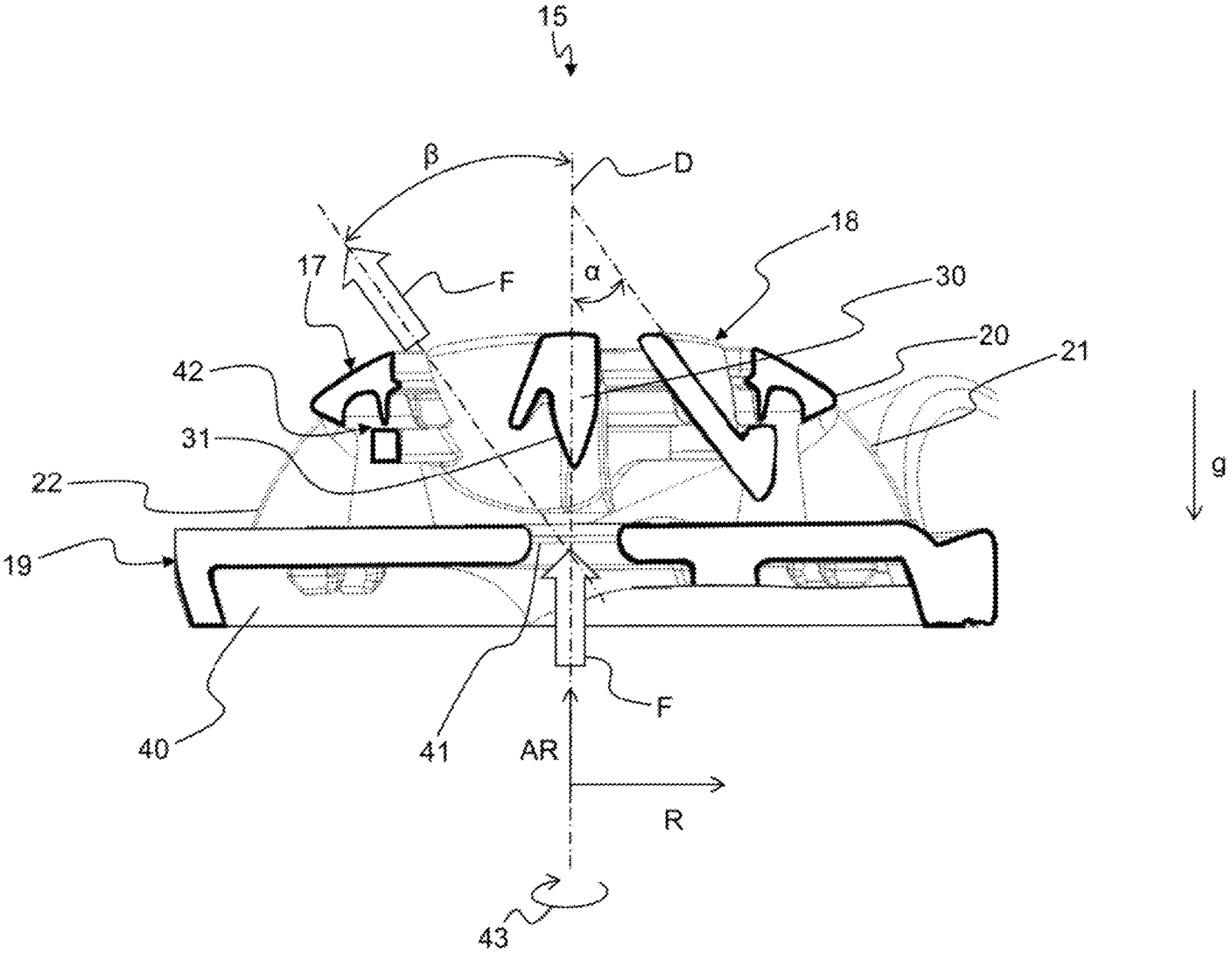
FIG. 3 shows a schematic sectional view of the spray device according to FIG. 2.

FIG. 2 shows a schematic perspective view of an embodiment of a spray device 15 for a household dishwasher 1. FIG. 3 shows a schematic sectional view of the spray device 15. The spray device 15 may be provided, for example, on the bottom 7, the ceiling 8, the rear wall 9, the side walls 10, 11 of one of the receptacles for items to be washed 12 to 14 or on spray arms, not shown, of the household dishwasher 1.

Preferably, a plurality of such spray devices 15 are provided. By means of the spray device 15, for example, a so-called intensive washing zone 16 (FIG. 1) may be implemented on one of the receptacles for items to be washed 12 to 14. By means of such an intensive washing zone 16 items to be washed which are heavily soiled and/or which are difficult to clean, such as for example bottles, dishes, bowls, pots or the like, may be cleaned particularly effectively. A plurality of such intensive washing zones 16 may be provided. The spray device 15 is designed to distribute and/or to spray washing liquor and/or clean water F inside the washing container 2.

The spray device 15 comprises a cage 17 (FIG. 4) and a rotary element 18 (FIG. 5) rotatably mounted in the cage 17. Moreover, the spray device 15 comprises a housing 19. The housing 19 may be configured integrally, in particular made of a single material, with the cage 17. Preferably, the cage 17, the rotary element 18 and the housing 19 are configured as plastic components, in particular as plastic injection-molded components. The rotary element 18 is rotatably mounted in the cage 17 about an axis of rotation D.

Figure 4:
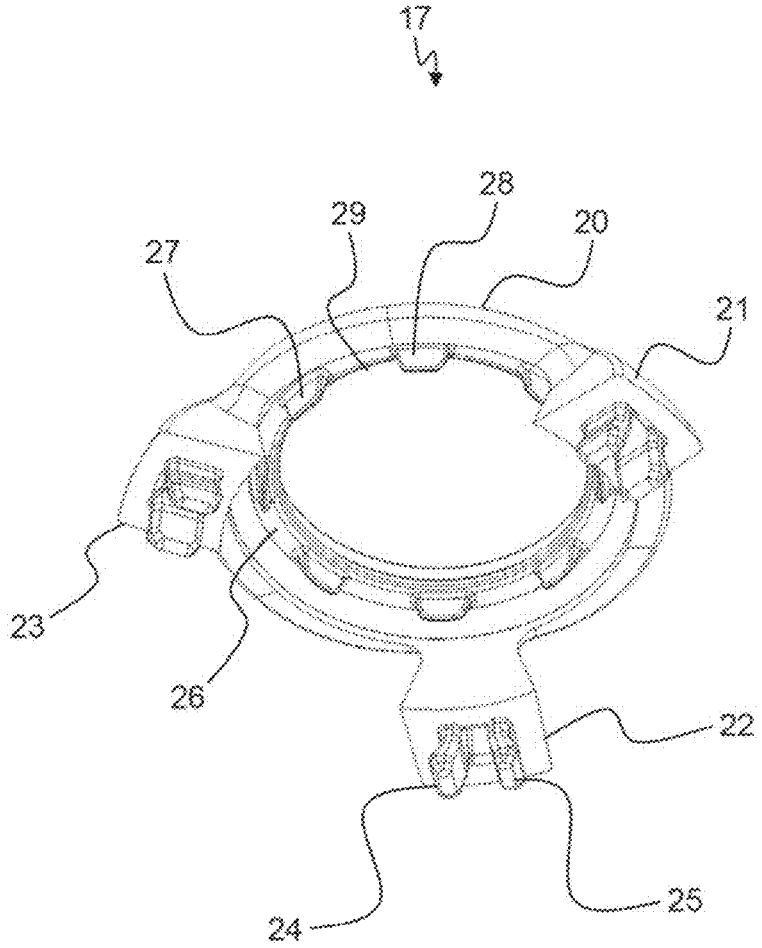
FIG. 4 shows a schematic perspective view of an embodiment of a cage for a spray device according to FIG. 2.

The cage 17 shown in FIG. 4 in a schematic perspective view comprises a bearing ring 20 circulating around the axis of rotation D. Three struts 21 to 23 are provided on the bearing ring 20. In this case, the struts 21 to 23 are configured integrally, in particular made of a single material, with the bearing ring 20. Preferably, three such struts 21 to 23 are provided. The number of struts 21 to 23, however, is variable. Preferably, at least two such struts 21 to 23 are provided. The struts 21 to 23 are distanced equally from one another and arranged so as to be distributed about a circumference of the bearing ring 20.

Each strut 21 to 23 has two resiliently deformable snap hooks 24, 25. The snap hooks 24, 25 are designed to engage in corresponding recesses of the housing 19, in order to connect the cage 17 with a positive fit to the housing 19. A positive-fit connection is produced by the interlocking or rear engagement of at least two connection partners, in this case the snap hooks 24, 25 and the corresponding recess of the housing 19. As FIG. 3 shows, the cage 17, in particular the bearing ring 20 and the struts 21 to 23, are curved, in particular curved in a spherical cap-shaped manner. In particular, an outer contour of the cage 17 is spherical cap-shaped.

An annular bearing surface 26 circulating about the axis of rotation D is provided on the inner face on the cage 17. The bearing surface 26 faces in the direction of the struts 21 to 23. A plurality of bearing portions 27, 28 extends out of the bearing surface 26. In FIG. 4, only two such bearing portions 27, 28 are provided with a reference numeral. For example, eight such bearing portions 27, 28 which are arranged equally distanced from one another are provided. In this case, in each case an intermediate space 29 is provided between two adjacent bearing portions 27, 28. In other words, an intermediate space 29 is provided between two bearing portions 27, 28 and a bearing portion 27, 28 is provided between two intermediate spaces 29.

The bearing portions 27, 28 extend in this case in the direction of the struts 21 to 23. The bearing portions 27, 28 are radially distanced from the axis of rotation D. In other words, the bearing portions 27, 28 are positioned so as to be distanced from the axis of rotation D in a radial direction R (FIG. 3). The radial direction R in this case is oriented perpendicular to the axis of rotation D and faces outwardly away from the axis of rotation D.

Figure 5:
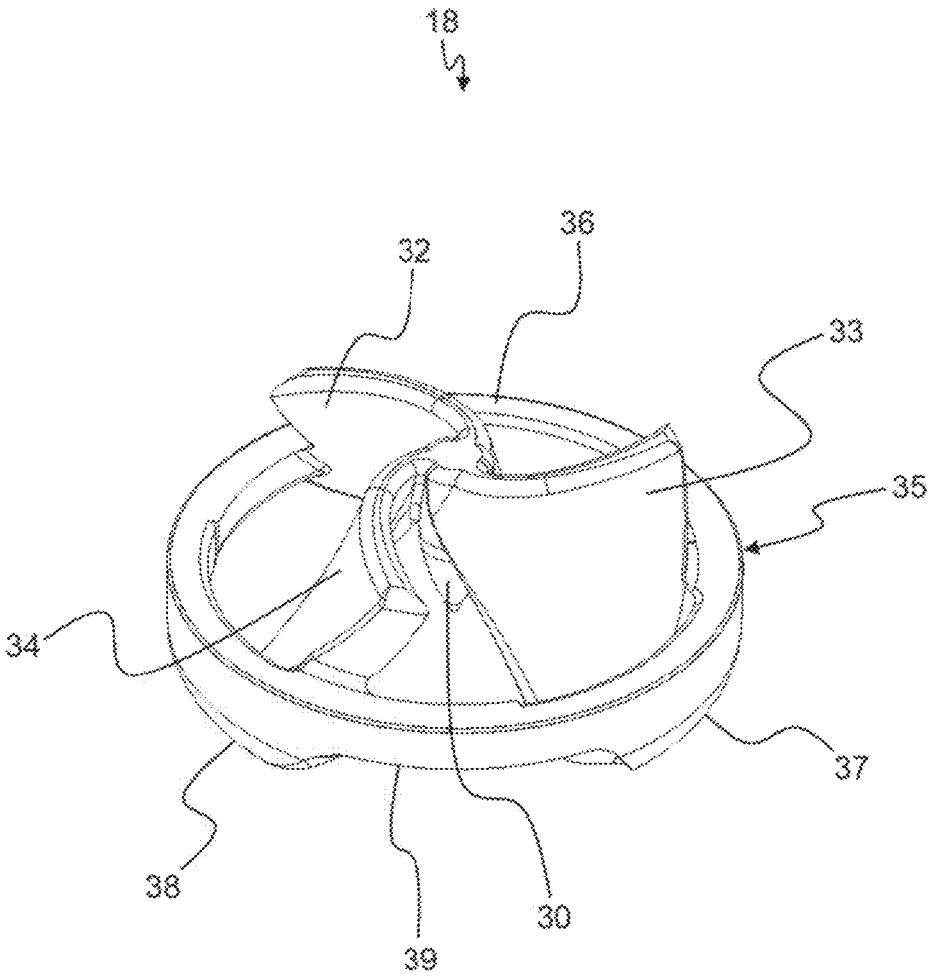
FIG. 5 shows a schematic perspective view of an embodiment of a rotary element for the spray device according to FIG. 2.

The rotary element 18 shown in FIG. 5 comprises a hub 30 which is constructed rotationally symmetrically to the axis of rotation D. The hub 30 may comprise an at least partially conical envelope surface 31 (FIG. 3). Moreover, the rotary element 18 comprises a plurality of rotor blades 32 to 34 connected integrally, in particular made of a single material, with the hub 30. The number of rotor blades 32 to 34 is arbitrary. Preferably, three such rotor blades 32 to 34 are provided. However, two, four or five rotor blades 32 to 34 may also be provided.

When said rotary element is supplied with the washing liquor and/or the clean water F, the rotary element 18 may be set in rotation about the axis of rotation D by means of the rotor blades 32 to 34. The rotor blades 32 to 34, as shown in FIG. 3, may be inclined at an angle of inclination a to the axis of rotation D. The angle of inclination a may, for example, be 40° to 70°, preferably 45° to 65°, further preferably 50° to 60°, further preferably 55°. The angle of inclination a, however, may adopt any other values.

The rotor blades 32 to 34 are also curved or bent in an arcuate manner, viewed in the radial direction R. The rotor blades 32 to 34 are connected together by means of a connecting ring 35 circulating around the rotary element 18. Viewed in the radial direction R, the connecting ring 35 is provided distanced from the axis of rotation D and circulating entirely around said axis of rotation. The connecting ring 35 comprises on the upper face a bearing surface 36 which circulates in an annular manner and fully around the axis of rotation D and which is designed to bear during the operation of the spray device 15 against the bearing portions 27, 28 of the cage 17. In other words, the rotary element 18 is rotatably mounted in the cage 17 by means of the bearing surface 36.

On the lower face, in other words remote from the bearing surface 36, a plurality of support portions 37, 38, for example three thereof, are provided on the connecting ring 35, the rotary element 18 being able to be positioned thereby on the housing 19. An intermediate space 39 is provided between two adjacent support portions 37, 38. The rotary element 18 is a plastic injection-molded component, as is the cage 17.

Now returning to FIG. 3, the housing 19 comprises a supply line 40 and a nozzle 41 for supplying the washing liquor and/or the clean water F to the rotary element 18. In this case, the nozzle 41 is designed to inject the washing liquor and/or the clean water centrally onto the rotary element 18, in other words onto the hub 30. As a result, the washing liquor and/or the clean water F may flow out of the nozzle 41 and/or be sprayed thereby at high pressure.

The nozzle 41 is preferably configured rotationally symmetrically relative to the axis of rotation D. Alternatively, the nozzle 41 may also be configured asymmetrically to the axis of rotation D and/or arranged offset relative thereto. Preferably, however, the nozzle 41 is positioned centrally below the hub 30 of the rotary element 18. The rotary element 18 may be arranged relative to a direction of gravitational force g above or below the nozzle 41. In the orientation of FIG. 3, the nozzle 41 is arranged below the rotary element 18 relative to the direction of gravitational force g.

The functionality of the spray device 15 is described hereinafter. Via the supply line 40 the nozzle 41 is supplied with washing liquor and/or clean water F. The washing liquor and/or the clean water F is injected by means of the nozzle 41 centrally onto the hub 30. As a result, the rotary element 18 is raised from the housing 19, so that the support portions 37, 38 are no longer in contact with the housing 19. An axial bearing clearance 42 between the bearing surface 36 and the bearing portions 27, 28 is reduced, viewed in an axial direction AR, such that the bearing surface 26 bears against the bearing portions 27, 28 of the cage 17. Thus a bearing of the rotary element 18 against the cage 17 is implemented in the axial direction AR.

Via the conical envelope surface 31 of the hub 30, the washing liquor and/or the clean water F is conducted away outwardly in the radial direction R and supplied at least partially to the rotor blades 32 to 34. As a result, the rotary element 18, as mentioned above, is set in rotation as is indicated in FIG. 3 by means of an arrow 43. Moreover, the washing liquor and/or the clean water F is also distributed by means of the rotor blades 32 to 34. A conical spray pattern, which may have a small dead region only in the region of the hub 30, is produced thereby around the spray device 15.

Depending on the application, the envelope surface 31 of the hub 30 may be freely designed so that, for example, this envelope surface has a flatter or steeper tip. In this case, a spray angle β of a spray jet and/or a spray pattern may also be influenced by the rotational speed of the rotary element 18. The higher the rotational speed, the flatter the spray angle β. The angle of inclination a of the rotor blades 32 to 34 is freely selectable and may be adapted according to the required drive torque.

In the axial direction AR, the bearing of the rotary element 18 in the cage 17 has the aforementioned bearing clearance 42. The same bearing clearance is also provided in the radial direction R. The bearing in the axial direction AR takes place in this case via the bearing surface 36 and the bearing portions 27, 28 of the cage 17. In this case, dirt particles may flow between the bearing portions 27, 28 through the intermediate spaces 29. As a result, there cannot be any jamming due to the dirt particles. The bearing in the radial direction and the centering are implemented via the washing liquor and/or the clean water F injected through the nozzle 41.

The spray device 15 has a plurality of advantages relative to known spray devices. By a corresponding design of the envelope surface 31 of the hub 30 and the angle of inclination a of the rotor blades 32 to 34, a freely definable spray pattern may be achieved. A minimal dead region may be achieved. This improves the cleaning performance. The functionality of the spray device 15 is clearly visible to a user and the added value easy to understand. By a corresponding bearing clearance both in the axial direction AR and in the radial direction R the spray device 15 is resistant to contamination. By the provision of the intermediate spaces 29 between the bearing portions 27, 28, a jamming of the rotary element 18 in the cage 17 due to dirt particles may be prevented. The dirt particles may be flushed through the intermediate spaces 29. In the case of a blockage of the rotary element 18, however, very effective emergency running characteristics are provided.

A very small installation height of the spray device 15 is produced. As a result, the spray device 15 may also be attached below the receptacles for items to be washed 12 to 14, for example for implementing the intensive washing zone 16. The spray device 15 is also able to be used for media such as air or steam. A uniform spray pattern, virtually without a spray shadow, in particular in the region of the hub 30, may be achieved by the external bearing. Moreover, in this type of bearing a deflection of the rotary element 18 is possible in the case of larger dirt particles. As a result, clogging or jamming of the spray device 15 due to dirt particles jammed between the hub 30 and the nozzle 41 is reliably prevented.

Whilst the present invention has been described with reference to exemplary embodiments, it may be modified in many different ways.

The invention claimed is:

1. A household dishwasher, comprising:

a washing compartment; and a spray device arranged inside the washing compartment and configured to spray washing liquor and/or clean water within the washing compartment, said spray device comprising a cage and a rotary element mounted in the cage for rotation about an axis of rotation, said rotary element comprising a plurality of rotor blades and a connecting ring which is disposed around the axis of rotation and which connects outer radial ends of the rotor blades together, the connecting ring defining an annular bearing surface radially distanced from the axis of rotation, facing in an axial direction with respect to the axis of rotation, and extending around the axis of rotation for enabling the rotary element to be mounted rotatably in the cage.

2. The household dishwasher of claim 1, wherein the cage comprises a plurality of bearing portions, said annular bearing surface of the connecting ring of the rotary element bearing against the plurality of bearing portions during operation of the spray device.

3. The household dishwasher of claim 2, wherein the plurality of bearing portions are arranged equally distanced from one another, with an intermediate space being provided between two adjacent ones of the plurality of bearing portions.

4. The household dishwasher of claim 2, wherein the cage comprises a bearing ring disposed around the axis of rotation, said plurality of bearing portions being provided on the bearing ring.

5. The household dishwasher of claim 1, further comprising a nozzle for supplying the washing liquor and/or the clean water to the rotary element, said nozzle being configured to inject the washing liquor and/or the clean water centrally onto the rotary element.

6. The household dishwasher of claim 1, wherein the rotary element comprises a hub connected to the rotor blades, said hub being configured to supply the washing liquor and/or the clean water to the rotor blades during operation of the spray device.

7. The household dishwasher of claim 6, wherein the hub is constructed rotationally symmetrically to the axis of rotation and includes an at least partially conical envelope surface.

8. The household dishwasher of claim 1, wherein the rotor blades are inclined at an angle of inclination relative to the axis of rotation.

9. The household dishwasher of claim 1, wherein the cage is curved.

10. The household dishwasher of claim 1, wherein the cage is curved in a spherical cap-shaped manner.

* * * * *